US008584609B2

(12) United States Patent
Stasolla et al.

(10) Patent No.: US 8,584,609 B2
(45) Date of Patent: Nov. 19, 2013

(54) TAPERED TUNNEL FOR TUNNEL THRUSTERS

(75) Inventors: Paolo Stasolla, Bari (IT); Eric Davis, Mequon, WI (US); Rick Davis, Mequon, WI (US)

(73) Assignee: ZF Friedrichshafen AG, Friendrichshafen (DE)

( * ) Notice: Subject to any disclaimer, the term of this patent is extended or adjusted under 35 U.S.C. 154(b) by 373 days.

(21) Appl. No.: 12/894,481

(22) Filed: Sep. 30, 2010

(65) Prior Publication Data

US 2011/0073029 A1 Mar. 31, 2011

Related U.S. Application Data

(60) Provisional application No. 61/247,189, filed on Sep. 30, 2009.

(51) Int. Cl.
*B63H 25/42* (2006.01)
*B63H 25/46* (2006.01)

(52) U.S. Cl.
USPC ..... 114/151

(58) Field of Classification Search
USPC ..... 114/150, 151, 144 R; 440/66–69
See application file for complete search history.

(56) References Cited

U.S. PATENT DOCUMENTS 3,127,865 A * 4/1964 Pleuger ..... 114/148
3,400,682 A * 9/1968 Jones, Jr. ..... 114/151
3,464,357 A * 9/1969 Gilbert et al. ..... 415/193
3,550,547 A * 12/1970 Pleuger et al. ..... 114/151
4,315,476 A * 2/1982 van der Tak ..... 114/151
4,377,981 A * 3/1983 Clausen ..... 114/151
6,152,793 A * 11/2000 Gongwer ..... 440/67

FOREIGN PATENT DOCUMENTS

JP 52029094 A * 3/1977
JP 59018094 A * 1/1984
JP 60215496 A * 10/1985
JP 2003276690 A * 10/2003
JP 2010083412 A * 4/2010

* cited by examiner

*Primary Examiner* — Ajay Vasudeva
(74) *Attorney, Agent, or Firm* — Davis & Bujold, PLLC; Michael J. Bujold

(57) ABSTRACT

A tunnel thruster system for a vessel. The tunnel thruster system includes a thruster propulsion mechanism including a drive unit driving a transmission and propeller assembly located within a thruster tunnel. The thruster tunnel comprising a propeller section, first and second tapered tunnel sections interconnected with one another by the propeller section, the propeller section and the first and the second tapered tunnel sections oriented substantially transversely to a keel of the vessel and accommodating the transmission and propeller assembly. Each tapered tunnel section extends from the propeller section to a tunnel opening through a hull of the vessel. Diameters of the first and the second tapered tunnel sections corresponding to a diameter of the propeller section at the propeller section and taper outward toward a larger diameter at each of the corresponding tunnel openings through the hull of the vessel.

20 Claims, 9 Drawing Sheets

TAPERED TUNNEL FOR TUNNEL THRUSTERS

FIELD OF THE INVENTION

The present invention relates to transverse tunnel thruster for a vessel for lateral propulsion of the vessel and, in particular, to an improved design for transverse tunnel thrusters.

BACKGROUND OF THE INVENTION

Marine craft frequently require the capability for precisely controlled navigation in confined or restricted waters and, in particular, for precise control and maneuvering of a vessel at low speeds. A typical and frequently occurring example of such low speed, precisely controlled maneuvering is the docking of a vessel wherein the vessel must be brought into a precisely controlled position with respect to a docking area, at very low speed which is often at or below the minimum speed at which conventional propulsion and steering systems can provide the necessary control of the vessel.

Although conventional propulsion and steering systems have been and still are commonly employed in such low speed, precise maneuvering of a vessel, conventional rudder and propeller systems present a number of difficulties in such maneuvers and typically require that a vessel be piloted by an experienced operator familiar with the particular and often unique characteristics of the vessel with respect to the steering and propulsion responses of the vessel and the responses of the vessel to such factors as, for example, wind and currents. In vessels having, for example, a conventional single propeller and rudder system or an odd number of propellers, the central propeller will typically generate an unbalanced transverse thrust that will tend to turn the vessel toward the port or the starboard side of the vessel, depending upon whether the central propeller has a right or left hand blade pitch and whether the propeller is rotating in a clockwise or counterclockwise direction. This effect may be mitigated or avoided in vessels having an even number of propellers by arranging the propellers with opposing blade pitches so that the propellers rotate in opposite directions, but still may occur if the engine speeds are different, thereby resulting in an unbalanced lateral thrust. This effect is accentuated at low speeds, and the problem is compounded because of the interactions between the angle and direction of water flow over the rudder or rudders caused by the propeller or the propellers and by the motion of the vessel through the water. While experienced pilots familiar with the characteristics of a given vessel or vessels may employ these effects while maneuvering a vessel, such experience is often lacking, and can result in undesirable outcomes, even for smaller vessels ranging from scratches, dents and damage to a docking area to major damage to or even the sinking of a vessel.

The above described problems with conventional propeller and rudder systems has resulted in the development of lateral thrusters mounted at or in the bow or bow and stern of a vessel and using transversely mounted propellers to generate lateral forces on the bow and/or stern of a vessel, thereby facilitating turning of the vessel and allowing a vessel to be moved or positioned laterally, including allowing a vessel to be held stationary against winds and currents. In general, bow thrusters are mounted in transverse tunnels extending from one side to the other side of the vessel at or near the bow, which is generally narrow compared to the mid-section of a vessel. Stern thrusters, however, because of the differing shapes assumed by the sterns of various vessels, may for example be mounted internally in the hull with inlet and outlet ports, in transverse passages or tunnels in a fin-like region of the keel forward of the propellers and rudders, or in cylindrical ducts or housings mounted transversely on the stern or transom of the vessel. In other implementations, thrusters may be mounted in or on retractable housings that are stored within the hull along the keel, when not in use, and that are extended below the keel when required.

Examples of conventional tunnel thruster installations of the prior art are shown in FIGS. 1A through 1C in which FIG. 1A illustrates a tunnel thruster system 1 that includes a tunnel thruster propulsion mechanism 10 having a single reversible propeller 12 mounted in a transverse tunnel 14 extending transversely to the keel axis 16K of the hull 16 of the vessel 18. A tunnel thruster system 1 is typically installed as far forward as possible in the hull to maximize the leverage effect around the pivot point and as deep as possible below the waterline to avoid any air from being sucked from above the water surface into the tunnel 14, which would significantly decrease the effectiveness of the tunnel thruster. As illustrated, the tunnel thruster propulsion mechanism 10 includes a drive unit 10A, typically an electric or hydraulic motor or a connection to an internal combustion engine, a motor mount 10B supporting a transmission and propeller assembly 10C, and a gearing or flexible drive shaft(s) for converting the rotation of a drive shaft 10D, connected with the drive unit 10A, into rotation of a propeller drive shaft 10E which drives a propeller 12. FIG. 1B illustrates a tunnel thruster system 1 similar to that of FIG. 1A, but in which the tunnel thruster propulsion mechanism 10 includes two opposed propellers 12A, 12B wherein the pitches of the blades of propellers 12A, 12B and the gearing of propeller assembly 100 are arranged so that the propellers 12A, 12B operate cooperatively to generate lateral thrust. In this regard, the pitches and drive trains of the propellers 12A and 12B may be arranged so that the propellers 12A and 12B either rotate in the same rotational direction or are counter-rotating, that is, the propellers 12A and 12B rotate in opposite rotational directions. FIG. 1C illustrates the central portion 14A of a transverse tunnel 14 of a tunnel thruster system 1 having opposed reversible propellers 12A, 12B, similar to that illustrated in FIG. 1B.

As discussed above, stern mounted tunnel thruster systems 1 are generally similar to the bow mounted tunnel thruster systems 1, illustrated in FIGS. 1A-1C, but may be mounted to a vessel differently due to the different shape of the stern regions of a vessel, as compared to the bow regions of the vessel. As described above, stern tunnel thruster systems 1 may, for example, be mounted internally in the hull with inlet and outlet ports, in transverse passages or tunnels in a fin-like region of the keel forward of the propellers and the rudders, or in cylindrical ducts or housings mounted transversely on the stern or transom of the vessel. In other implementations, the tunnel thruster systems may be mounted on or in retractable mountings, stored within the hull along the keel when not in use, and extended below the keel when required, and may be rotatable about a vertical axis to allow the thrust, generated by the thruster system, to be directed at a range of angles relative to the keel of the vessel or possibly mounted internally within inlet or outlet ports.

Tunnel thruster systems, however, suffer from a number of disadvantages and limitations that are inherent in the flow of water through a cylindrical passage, that is, the tunnel of a tunnel thruster system, and the interaction between a propeller and the water flowing in the tunnel. For example, the thruster tunnel inherently restricts the volume of the water flowing through the propellers region of influence, thereby correspondingly restricting the thrust than can be generated by the propeller, and the interaction between the water and the tunnel boundaries presents a significantly higher flow resistance compared to a propeller acting in an open flow region, both of which result in significantly reduced efficiency compared to a propeller acting in an open flow region. The effects of the tunnel on water flow characteristics also often result in the generation of high levels of noise due to propeller cavitation, as discussed in further detail below.

Considering the inherent disadvantages and limitations of tunnel thruster systems in further detail, and considering bow thruster systems as exemplary of all forms of tunnel thrusters, FIG. 2A is a diagrammatic illustration of the flow of water into and through a tunnel 14 of a conventional tunnel thruster system 1 of the prior art and illustrates the effects of the shape of the transition region 20 between the entrance of tunnel 14 and the hull 16 and, in particular, the effects of a too sharp or badly rounded tunnel 14 to hull 16 configuration. As indicated therein, a too sharp or badly rounded hull 16 to tunnel 14 flow transition region 20, such as at flow discontinuity 20D, or any other form of discontinuity or too abrupt a change in the path of fluid flow, such as a discontinuity or too sharp a gradient in the wall 22 surface, will result in the formation of a urbulence region 24T near the wall 22 surface wherein a turbulence region 24T is characterized by macroscopic turbulence, a detached boundary layer, eddies and vortices while the flow of water in a non-turbulent inner zone 24L is characterized by an undetached boundary layer and little or no turbulence, eddies or vortices. The turbulence, eddies and vortices in a turbulence region 24T results in and determines the magnitude of a reduction in the rate of flow of water in the turbulence region 24T, that is, a reduction in the mean axial flow speed of the water near the tunnel wall 22. This, in turn, results in a slowing of the fluid flow adjacent the walls 22 of the tunnel 14 and may adversely affect the effectiveness and the efficiency of the thruster propeller 12, 12A or 12B. That is, and as illustrated in FIG. 2C, the reduction in the mean axial speed ($V_A$-speed of advance) of the water flow near the wall 22 will, in turn, result in and determine an increase in the angle between the velocity of the water relative to the blade and pitch line, that is, the angle of attack of the blade of the propeller 12, 12A or 12B. In addition, the turbulence in the water flow around the propellers creates irregular and unpredictable velocity variations along the propeller blade surfaces, thereby making it difficult to optimize the propeller design in order to reduce noise and increase efficiency and performance.

The solution to such fluid flow problems in thruster tunnels 14 that have been most commonly recommended and adopted in the prior art, as is illustrated in FIG. 2B, is to round the juncture between the hull 16 and the tunnel wall 22 to thruster tunnel flow transition region 20 so as to avoid flow separation and the formation of turbulence regions 24T, with the most common recommendation being that the optimum radius of the transition region 20 be on the order of 10% of the tunnel 14 diameter. This solution is believed to not only reduce the water flow characteristics leading to the turbulence region 24T, but to allow the thruster 10 to draw water from a region around the tunnel 14 opening in the hull 16. The increased movement of water over a larger area results in a suction pressure acting on the hull surface that increases the effect and efficiency of the thruster 10 proportional to the increase in area of the hull surface on which the suction pressure is exerted due to the increased radius of the transition region 20.

It is well known, however, that the achievement of the recommended optimum hull 16 to the thruster tunnel flow transition region 20 shape presents significant design problems in, for example, achieving the necessary hull structural strength, significant increases material and hull space costs and requirements and construction time and effort, so that these solutions of the prior art generally have proven unsatisfactory.

The present invention provides a solution to these and related problems of the prior.

SUMMARY OF THE INVENTION

The present invention is directed to a tunnel thruster system for a vessel, the tunnel thruster system including a thruster propulsion mechanism including drive unit driving a transmission and propeller assembly in a thruster tunnel, the thruster tunnel comprising a propeller section, first and second tapered tunnel sections interconnected with one another by the propeller section, the propeller section and the first and the second tapered tunnel sections oriented substantially transversely to a keel of the vessel and accommodating the transmission and propeller assembly, each tapered tunnel section extending from the propeller section to a tunnel opening through a hull of the vessel, and diameters of the first and the second tapered tunnel sections corresponding to a diameter of the propeller section at the propeller section and tapering outward toward a larger diameter at each of the corresponding tunnel openings through the hull of the vessel.

In presently preferred embodiments, an outward angle of taper of a wall of each of the first and second tapered tunnel sections, relative to the common axis of the propeller and first and second tapered tunnel sections, is in range of 1 degree per side to 10 degrees per side relative to the axis of the tunnel, and is preferably on the order of 4 degrees per side. In further embodiments of the invention, the transmission and propeller assembly may include a single propeller which can rotate in both a first thrust direction and a second opposite thrust direction (as in FIG. 1A, for example), a pair of propellers with one propeller being located on each side of the transmission and propeller assembly and both of the propellers rotating concurrently with one another in the same rotational direction, e.g., both simultaneously rotating in either a first thrust direction or a second opposite thrust direction (as in FIG. 1B, for example), or a pair of contra-rotating propellers supported by the transmission and propeller assembly, one behind the other and both simultaneously rotating in opposite rotational directions (as in FIGS. 1B, 3A and 5A, for example), with the rotation of the pair of contra-rotating propellers either providing thrust in a first direction or thrust in a second opposite direction.

In still further embodiments, the transmission and propeller assembly and tunnel of the tunnel thruster system may be mounted in an azimuthally rotatable enclosure to allow a thrust generated by the thruster system to be directed at a range of angles relative to the keel of the vessel.

DESCRIPTION OF THE DRAWINGS

The above discussed aspects of the prior art and the following discussed aspects of the present invention are illustrated in the figures, wherein.

DESCRIPTION OF THE INVENTION

Figure 3A:
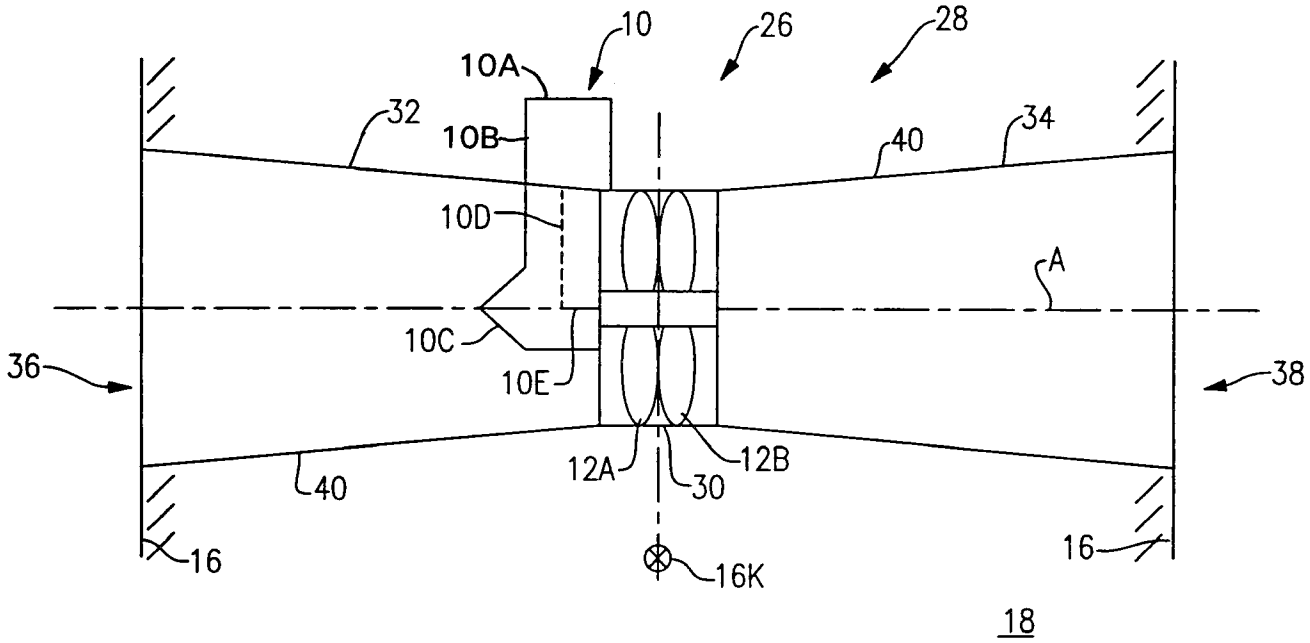
FIG. 3A is a diagrammatic illustration of a first exemplary embodiment of a tunnel sections of a tapered tunnel thruster of the present invention.

Referring to FIG. 3A, therein is shown a diagrammatic illustration of a first exemplary embodiment of a tunnel thruster system 26 according to the present invention.

As shown therein, the first embodiment of the tunnel thruster system 26 of the present invention again includes a thruster propulsion mechanism 10 that includes drive unit 10A, a motor mount 10B supporting a transmission and propeller assembly 10C and converting rotation of the drive shaft 10D, connected with the drive unit 10A, into rotation of the propeller drive shaft 10E which drives the propellers 12A, 12B. The propellers 12A, 12B are both mounted together on the same side of transmission and propeller assembly 10C and are spaced apart from one another by no more than one half of the propeller diameters, with the pitches of the blades of propellers 12A, 12B and the drive trains of propeller 12A and 12B being selected so that propellers 12A, 12B operate cooperatively to generate lateral thrust. In a presently preferred embodiment of the propellers 12A and 12B, they rotate in opposite rotational directions from one another so that the downstream propeller 12A or 12B, in the direction of the water flow, is able to recover at least a part of the slipstream rotational energy of the upstream propeller 12B or 12A. In other embodiments, it is possible for the pitches and/or the drive trains of the propellers 12A and 12B to again be arranged on the same side of the transmission and propeller assembly 10C, as shown in FIG. 3A, either within or outside one half of the propeller diameter of each other, but with both of the propellers 12A and 12B rotating in the same rotational direction.

Figure 1A:
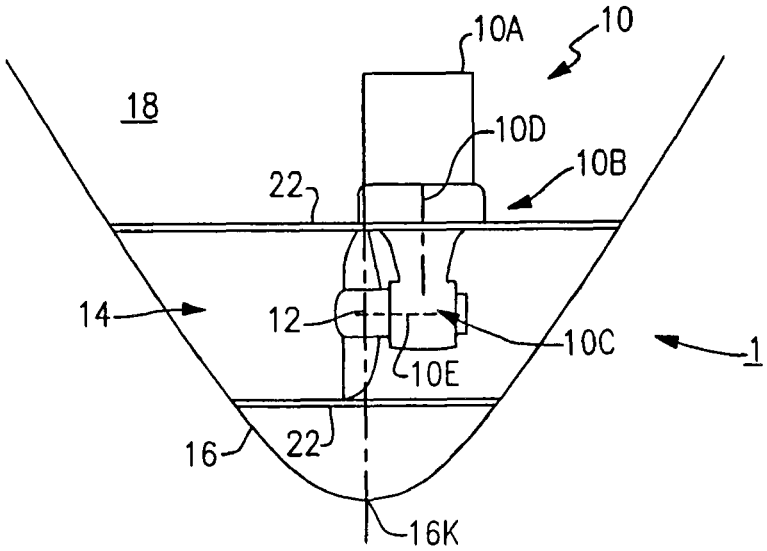
FIG.1A PRIOR ART
FIGS. 1A-1C are diagrammatic representations of conventional thrusters of the prior art.
Figure 1B:
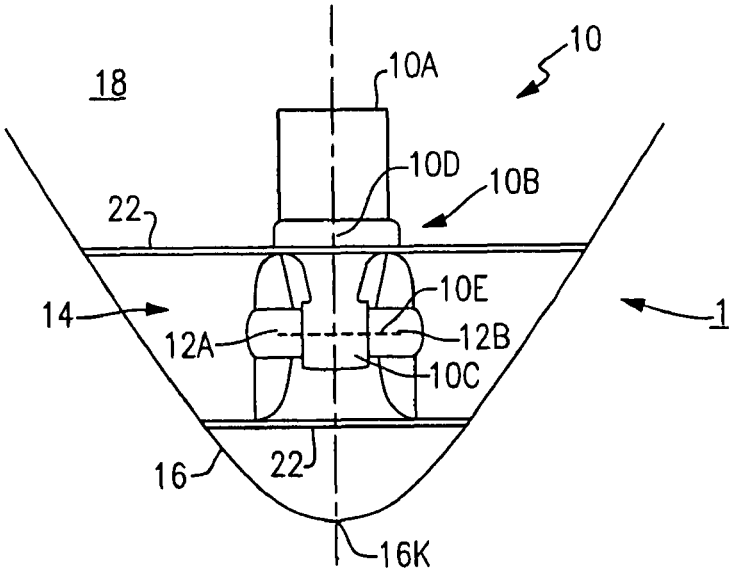
FIG.1B PRIOR ART
Figure 1C:
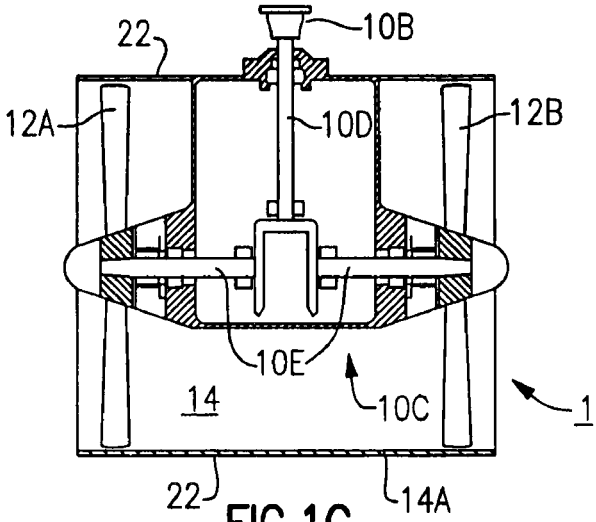
FIG.1C PRIOR ART
Figure 2C:
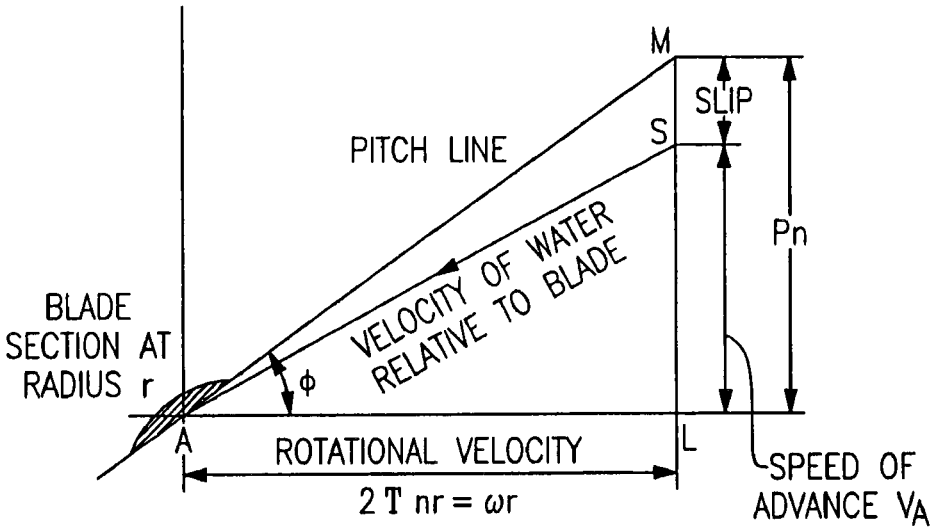
FIG.2C PRIOR ART
FIGS. 2A, 2B and 2C are diagrammatic illustrations of problems of conventional thrusters of the prior art.
Figure 2A:
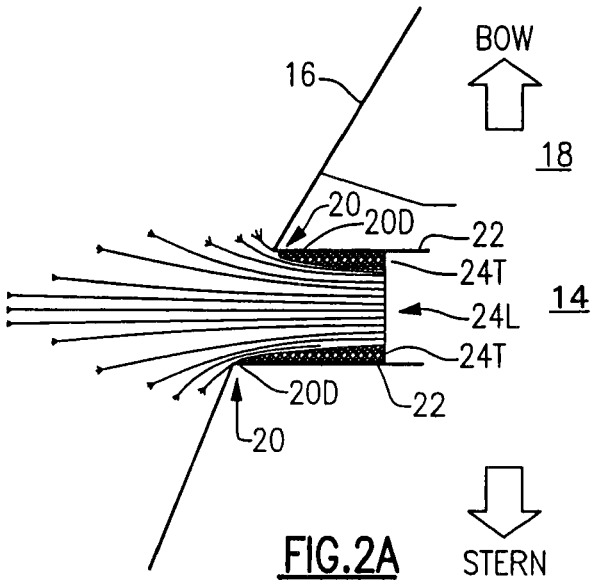
FIG.2A PRIOR ART
Figure 2B:
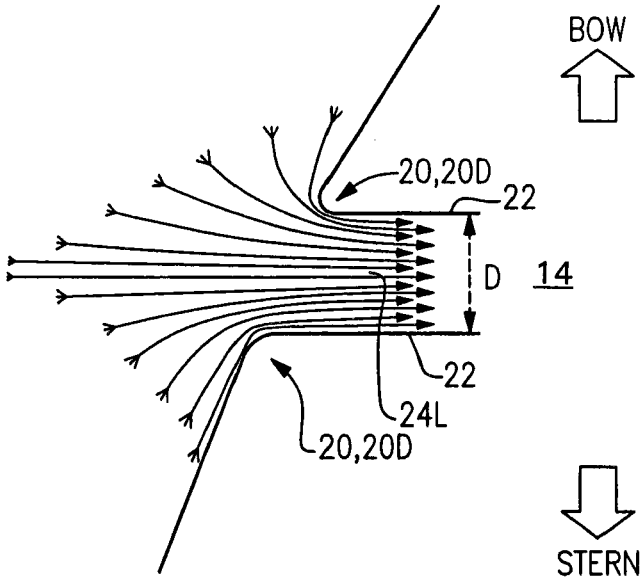
FIG.2B PRIOR ART

In other embodiments, the propellers 12A and 12B may be mounted on opposite sides of the transmission and propeller assembly 10C and may again be contra-rotating or may rotate in the same direction, as illustrated in FIGS. 1B and 1C, or the thruster propulsion system 10 may include a single reversible propeller 12, as illustrated in FIG. 1A. It should also be noted that in further alternative embodiments, the transmission and propeller assembly 10C and the propeller 12 or the propellers 12A, 12B may be arranged so that either the transmission and propeller assembly 10C or the propeller 12 or the propellers 12A, 12B are located in a propeller section 30, which is located between and joins tapered tunnel sections 32 and 34, with the other of transmission and propeller assembly 10C or the propeller 12 or the propellers 12A, 12B being located in one of the tapered tunnel sections 32 and 34 adjacent the propeller section 30, as discussed below with reference to FIGS. 3I through 3M.

As also shown in FIG. 3A, the propeller 12 or the propellers 12A, 12B are mounted and supported in a dual or doubly tapered tunnel 28 normally having the propeller section 30 located between and joining or interconnecting the first and the second tapered tunnel sections 32 and 34 with one another. One end of each of the first and the second tapered tunnel sections 32 and 34 extends from the propeller section 30 to the corresponding tunnel/hull opening 36, 38 of the tunnel 28 through the hull 16 at the intersections of the tunnel wall 40 with the hull 16. Each of the first and the second tapered tunnel sections 32 and 34 expands, or tapers outward, from their smallest diameter, located at the propeller section 30, to their largest diameter located at the tunnel/hull openings 36, 38. As represented, the propeller section 30 and the tapered tunnel sections 32 and 34 are oriented transversely with respect to the keel 16K of the vessel 18. The diameter of propeller section 30 accommodates the diameter of the propeller 12 or the propellers 12A, 12B, as with a conventional tunnel 14, and the length of the propeller section 30 is determined by length of the tunnel 28 required to accommodate the propeller 12 or the propellers 12A, 12B and to allow a flow of water free of macroscopic turbulence to the propeller 12 or the propellers 12A, 12B.

As longitudinal profile of the propeller section 30, that is, the cross section of the propeller section 30 along an axis A extending between the tapered tunnel sections 32 and 34 of the tunnel 28, may be cylindrical of a length determined by the propeller 12 or the propellers 12A, 12B and the desired flow of water through the propeller section 30. In other embodiments, the propeller section 30 may be formed of the intersection of the inner ends of the tapered tunnel sections 32 and 34 of the tunnel 28, thereby being of effectively of a zero length. In presently preferred embodiments of the propeller section 30, however, to provide an optimum fluid flow into, through and out of the propeller section 30, and to avoid or reduce the possibility of a boundary layer flow separation or formation of a turbulence region 24T in the region of the propeller section 30, the longitudinal profile of the propeller section 30 is generally rounded or curved to maintain a non-turbulent flow of water to the propeller 12 or the propellers 12A, 12B.

As described just above, and according to the present invention, the tunnel 28 of the thruster system 26 includes the tapered tunnel sections 32 and 34 extending from the propeller section 30, which may be of any of the forms described above, to the corresponding tunnel/hull openings 36, 38 of the tunnel 28 through the hull 16. As shown, the larger diameter end of the tapered tunnel sections 32 and 34 are located at the tunnel/hull openings 36, 38 of the tunnel 28 through the hull 16 and the tapered tunnel sections 32 and 34 taper down toward their narrowest diameter end located at the propeller section 30, which is generally slightly larger than the diameter of the propeller 12 or the propellers 12A and 12B.

Figure 3B:
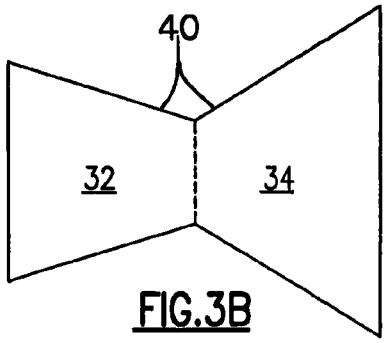
FIGS. 3B through 3H are diagrammatic illustrations of alternate embodiments of tunnel sections of the tapered tunnel thruster of the present invention.

Referring to alternate tunnel configurations, as illustrated in FIGS. 3B through 3H, FIG. 3A and the above discussion of the tapered thruster tunnel 28 was directed to an embodiment of the tunnel 28 in which the tunnel 28 includes symmetrical, straight walled tunnel sections 32, 34, so that each tunnel section 32, 34 assumes the form of a straight walled cone. FIG. 3B, in turn, is a diagrammatic illustration of an embodiment of a tunnel 28 having non-symmetric tunnel sections 32, 34 in which the diameter of one of the tunnel sections 32 or 34, at the corresponding hull/tunnel opening 36, 38, is larger than the diameter of the other one of tunnel sections 34 or 32 at the corresponding hull/tunnel opening 36, 38 with a correspondingly greater angle of taper for the tunnel wall 40 in that tunnel section 32, 34 than in the other tunnel section 32, 34. The non-symmetric configuration, as illustrated in FIG. 3B, may be used, for example, to allow one of tunnel sections 32, 34, that is, the tunnel section 32, 34 having the larger diameter, to accommodate the transmission and propeller assembly 10C when the propeller 12 or the propellers 12A, 12B are located in the propeller section 30 and the transmission and propeller assembly 10C is offset into one of the tunnel sections 32 or 34. In other instances, a non-symmetric tunnel 28 may be employed, for example, to accommodate a differential volume or velocity of the water flow between the two tunnel sections 32, 34, with the larger diameter tunnel section 32, 34.

Figure 3C:
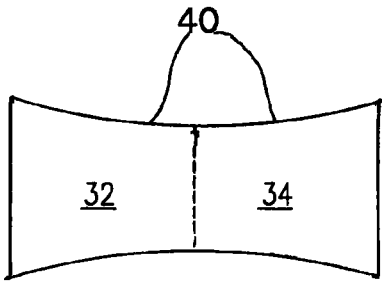
Figure 3D:
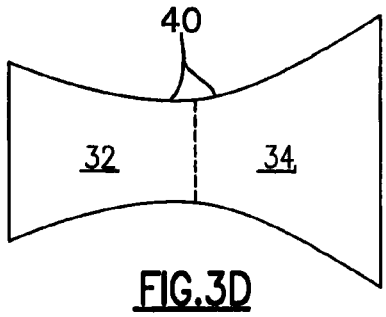

Referring to FIGS. 3C and 3D, diagrammatic illustrations of symmetric and non-symmetric embodiments of the tunnel 28 are shown therein in which the walls 40 of the tunnel sections 32, 34 are not straight or conical but instead have curved longitudinal profiles with the walls 40 being convex towards the axes of the tunnel sections 32, 34 so that the taper of the tunnel sections 32, 34 is curved rather than being conical, flat, or straight. It will be recognized that in embodiments having a curved taper or taper(s), the average angle or slope of the curved walls 40, taken over the entire length of the tunnel sections 32, 34, i.e., from the tunnel/hull openings 36, 38 to the propeller section 30, will be in the same range of values as those embodiments having straight or conical walls 40 in the tunnel sections 32, 34.

Figure 3E:
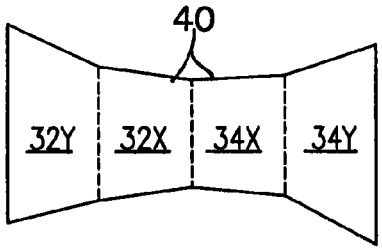
Figure 3F:
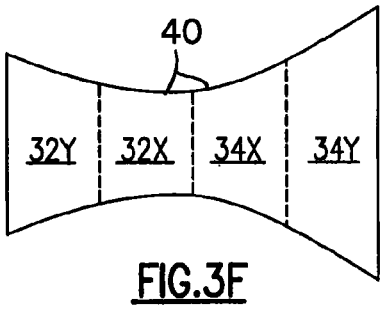

FIGS. 3E and 3F are diagrammatic illustrations of symmetric and non-symmetric embodiments of the tunnel 28 in which the tunnel sections 32, 34 each comprise a plurality of the tunnel subsections 32X, 32Y, 34X, 34Y, and so on, hereafter referred to as the tunnel subsections 32XY, 34XY, wherein each of the tunnel subsections 32XY, 34XY comprises a tapering straight walled section but wherein the angle of taper or the slope of the walls 40, in each of tunnel subsections 32XY, 34XY, is progressively larger from an innermost one of the tunnel subsections 32XY, 34XY to an outermost one of the tunnel subsections 32XY, 34XY. It will be recognized that the embodiment of a tunnel 28 comprising a plurality of sequentially arranged straight walled tunnel subsections allows for fabrication of an approximation to a curved wall tunnel, from a plurality of sequentially arranged straight walled subsections, and that the average angle or slope of the segmented walls 40, taken over entire length of the tunnel sections 32XY, 34XY, i.e., from the tunnel/hull openings 36, 38 to the propeller section 30, will be in the same range of values as those embodiments having straight or conical walls 40 in the tunnel sections 32, 34. It will also be recognized that, and for example, the fabrication of the tunnel sections 32, 34 as straight or conical walled subsections may, in certain respects, be less complex and expensive than curved wall sections.

Figure 3G:
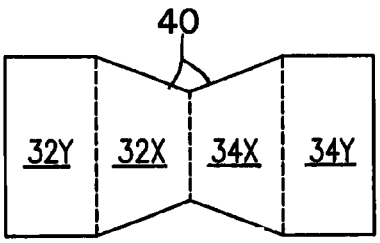
Figure 3H:
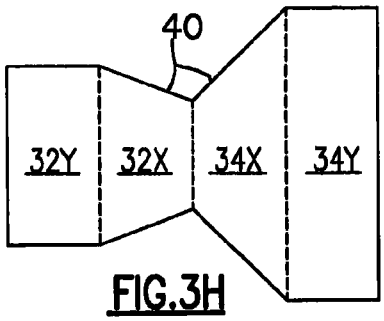
Figure 3I:
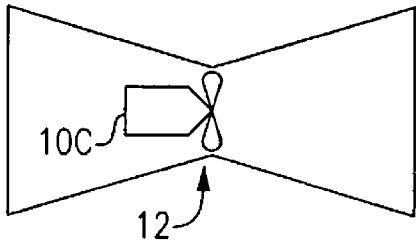
FIGS. 3I through 3M are diagrammatic illustrations of alternate mountings of propellers and propeller assemblies and gearcases in a tapered tunnel of the present invention.
Figure 3J:
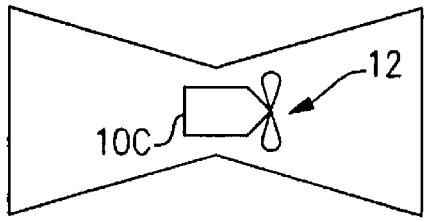
Figure 3K:
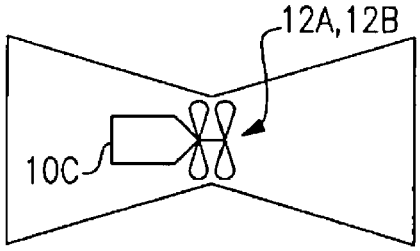
Figure 3L:
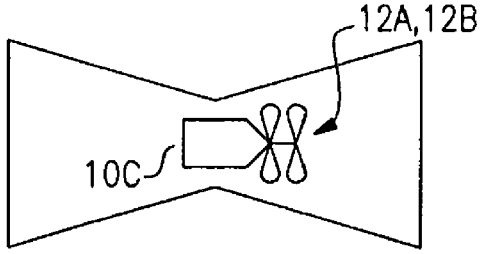
Figure 3M:
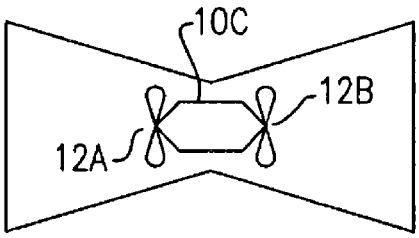

FIGS. 3G and 3H are diagrammatic illustrations of symmetric and non-symmetric embodiments of a straight wall, segmented tunnel 28, similar to those illustrated in FIGS. 3E and 3F, but in which an outermost one of the tunnel subsections 32XY, 34XY comprises the tunnel subsections 32XY, 34XY where the slope or angle of the walls 40 is zero, so that the outermost tunnel subsections 32XY, 34XY comprise parallel walled cylinders. Again, it will also be recognized that in certain circumstances the fabrication of the tunnel sections 32, 34, as straight walled subsections, may in certain respects be less complex and expensive than others of the embodiments described herein above.

Lastly, FIGS. 3I through 3M are general diagrammatic illustrations of possible alternative mountings of the transmission and propeller assembly 10C and the propeller 12 or the propellers 12A and 12B in the tunnel 28 of the present invention. As represented therein, the propeller 12 or the propellers 12A and 12B may be mounted at the region of the intersection of the tapered tunnel sections 32 and 34 and transmission and propeller assembly 10C, which typically includes the gearcase as part of the propeller assembly, being mounted in one of tapered tunnel sections 32 or 34, or the reverse, with the propeller assembly and the gearcase thereof being mounted in the region of the intersection of the tapered tunnel sections 32 and 34 and the propeller 12 or the propellers 12A and 12*b* being mounted in at least one of the tapered tunnel sections 32 and 34, dependent on the number and arrangement of the propellers 12, 12A and/or 12B. As generally shown in FIGS. 3I through 3M, the gearcase is mounted parallel to an axis of the propeller shaft. In addition, as generally shown in the FIGS. 3A, 5A and 5B, the gearcase is mounted on a wall of one of the first and the second tapered tunnel sections.

Figure 4A:
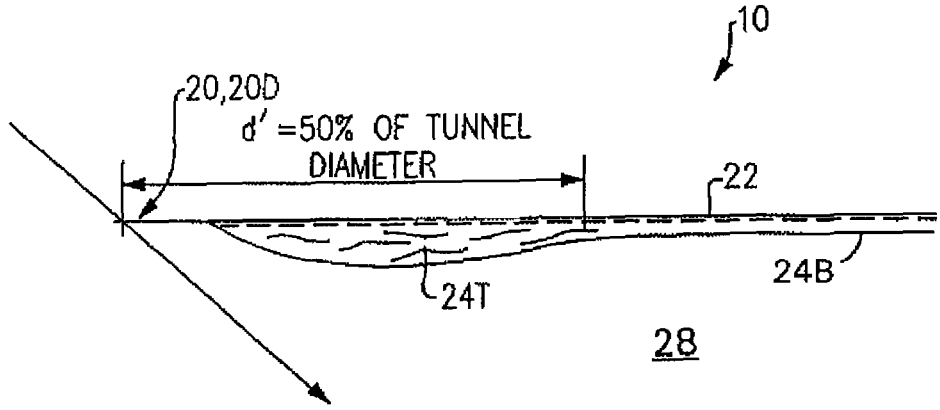
FIG.4A PRIOR ART
FIG. 4A is a diagrammatic illustration of fluid flow in a conventional tunnel thruster of the prior art.
Figure 4B:
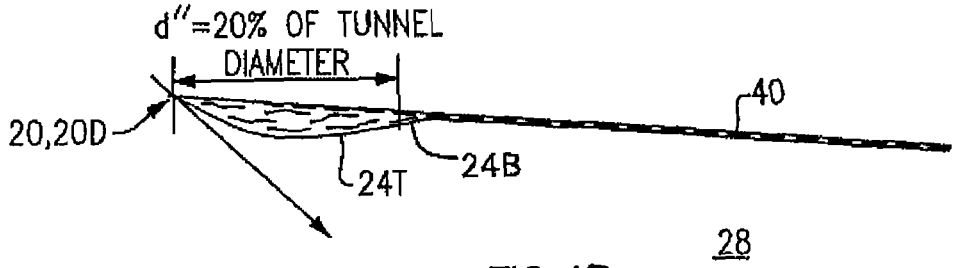
FIG. 4B is a diagrammatic illustration of fluid flow in a tapered tunnel thruster of the present invention.

Next considering the benefits of tapered tunnels 28 as described herein above, it has been found that the tapered shape of tapered tunnel sections 32 and 34 significantly reduce the probability of boundary layer separation at a flow transition region 20, such as at the tunnel/hull openings 36, 38, even if the flow transition region 20 at the tunnel/hull openings 36, 38 is not optimally rounded, by reducing the redirection of water flow at the tunnel/hull openings 36, 38. It has also been found that even if boundary layer separation should occur, again such as at the tunnel/hull openings 36, 38, the extent of the turbulence region 24T is significantly reduced so that the turbulence region 24T typically does not extend to the region of the propeller 12 or the propellers 12A and 12B, thereby also reducing the possibility of cavitation at the propeller 12 or the propellers 12A, 12B. Generally speaking, the acceleration of water through the venturi formed by the tapered tunnel 28 eliminates the boundary layer separation at optimal velocities and thereby eliminates the boundary effect of cavitation The effects of a tapered tunnel 28 of the present invention are illustrated in FIGS. 4A and 4B which illustrates the results of flow separation analyses on, respectively, a conventional cylindrical tunnel 14 of a thruster 10 of the prior art and the tunnel 28 of the thruster 26 of the present invention for tunnels 14 and 28 of generally corresponding dimensions and fluid flow rates. Referring first to FIG. 4A and a conventional cylindrical tunnel 14, upon the occurrence of a boundary layer separation in a conventional cylindrical tunnel 14, such as at the interface or juncture between the hull 16 and the tunnel wall 22, the boundary layer 22B reattaches and the turbulence region 24T ends in a distance d wherein d is measured from the opening of the tunnel 14 along the central axis of the tunnel 14 and is approximately 50% of the diameter D of the tunnel 14. As is apparent, therefore, the turbulence region 24T will often extend to the propeller 12 or the propellers 12A, 12B, thereby resulting in propeller cavitation, vibration, noise and loss of power and efficiency.

Referring to FIG. 4B and an exemplary embodiment of the tapered tunnel 28 according to the present invention with a 4° wall taper, upon the occurrence of a boundary layer separation, such as at the juncture between the hull 16 and the tunnel wall 40, the boundary layer 24B reattaches and the turbulence region 24T ends a distance d wherein d is measured from the opening of tunnel 28 along the central axis of the tunnel 28 and is approximately 20% of the diameter D of the tunnel 28. As a result, the turbulence region 24T does not extend to the propeller 12 or the propellers 12A, 12B and propeller cavitation is thereby avoided, thereby significantly reducing or avoiding vibration, noise and a corresponding loss of power and efficiency. The extension of the turbulence region 24T to the propeller 12 or the propellers 12A, 12B would, according to the present invention, represent a worst case of the boundary layer separation, but, according to the present invention, could be completely avoided by a tapered tunnel design as described herein.

Figure 5A:
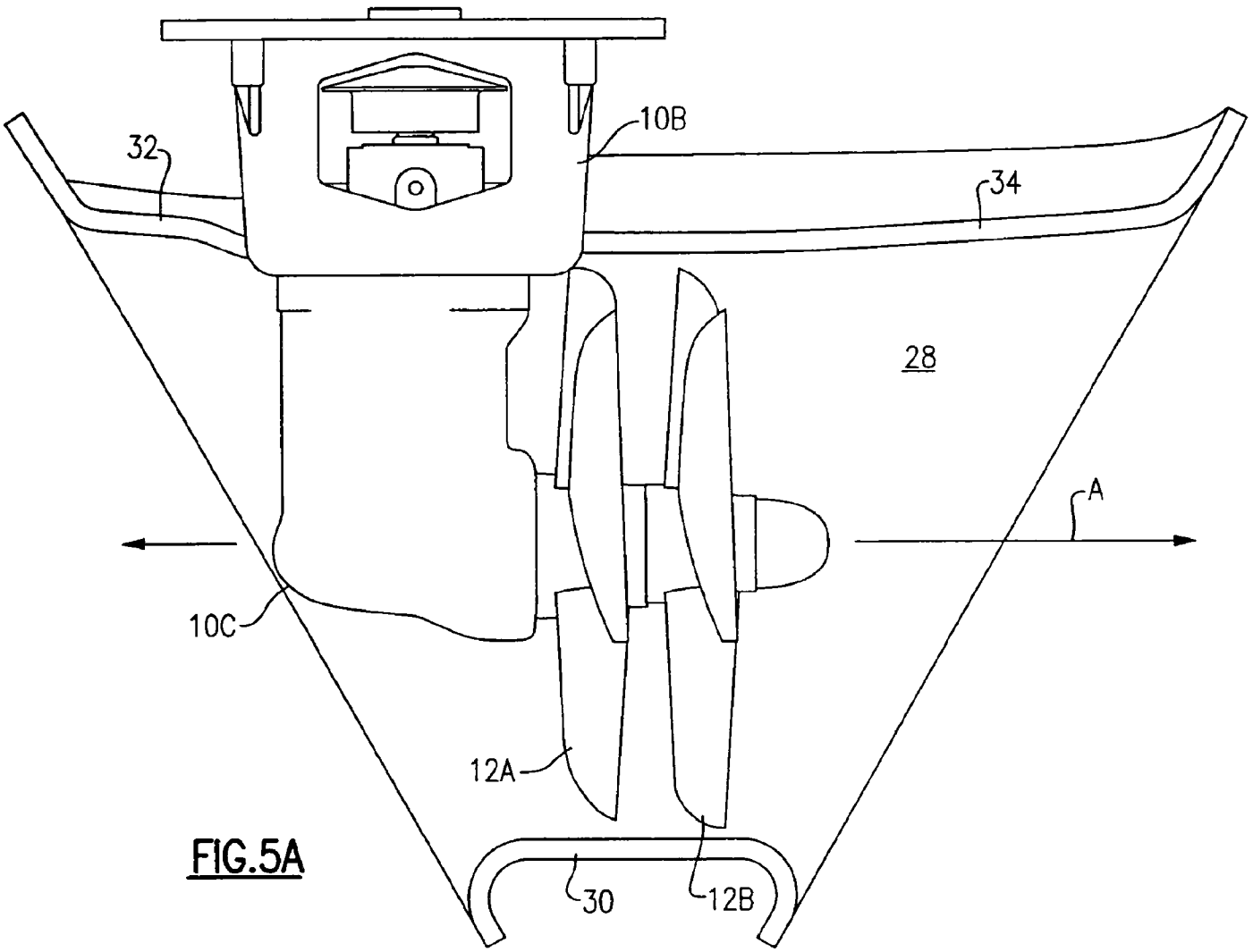
FIG. 5A is a diagrammatic cross sectional view of a preferred embodiment showing the arrangement of the propellers and the propeller assembly within the tunnel section of the tapered tunnel thruster.
Figure 5B:
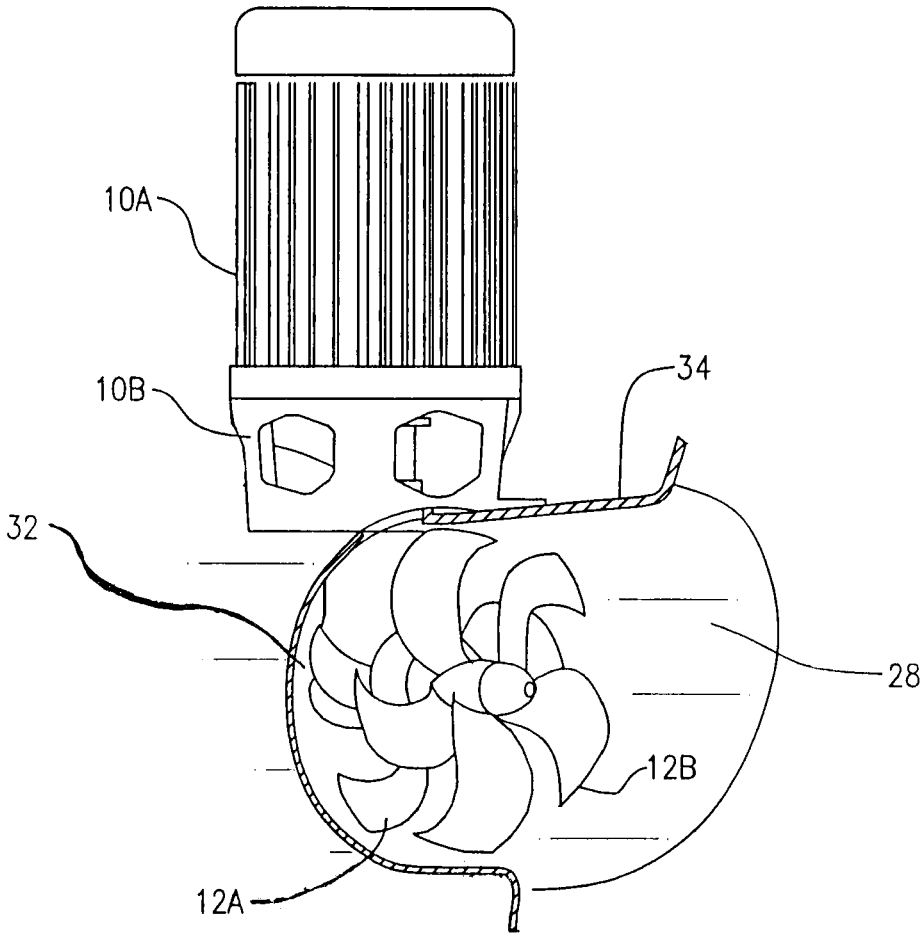
FIG. 5B is a diagrammatic perspective view of the embodiment showing in FIG. 5A.

A preferred form of the tunnel thruster system for a vessel is shown in FIGS. 5A and 5B. According to this embodiment, a pair of contra-rotating propellers 12A, 12B are both supported on one side of the transmission and propeller assembly 10C. The pair of contra-rotating propellers 12A, 12B are generally located centrally within the tunnel 28 while the transmission and propeller assembly 10C is generally accommodated or located within the first tapered tunnel section 32 and is mounted to the tunnel by a motor mount 10B and driven by a drive unit 10A. Each of the first and the second tapered tunnel sections 32, 34 has a wall with a taper of about 4°, with respect to a common central axis A of the first and the second tapered tunnel sections 32, 34 with the propeller section 30 generally being formed by the intersection of the first and the second tapered tunnel sections 32, 34 with the diameter of the propeller section 30.

According to the present invention, the preferred ratios of the diameter of the first and the second tunnel/hull openings 36, 38 to the diameter of the propeller section 30 is in the range of 1.1:1 to 1.25:1, with a preferred ratio being in the range of 1.13:1 to 1.20:1, and a corresponding range of the ratio of the length of the first and the second tapered tunnel sections 32 and 34 to the diameter of the tunnel/hull openings 36, 38 is on the order of 0.83 to 1.7, with a preferred value in the range of 0.90 to 1.5. The range of ratio of the length of tapered tunnel sections 32 and 34 to the diameter of propeller section 30 on the order of 0.9 to 2.0, with a preferred value in the range of 0.95, and the angle of taper of wall 40 relative to the central axis A of the tapered tunnel 28 is in the range of 0.5° to 15°, with a preferred value in the range of 4°.

In conclusion, and while the invention has been particularly shown and described with reference to preferred embodiments of the apparatus and methods thereof, it will be also understood by those of ordinary skill in the art that various changes, variations and modifications in form, details and implementation may be made therein without departing from the spirit and scope of the invention as defined by the appended claims. For example, the tapered tunnel 28 and transmission and propeller assembly may be mounted in a rotatable enclosure or housing, thereby allowing the thrust generated by the thruster system to be azimuthally rotated to allow the thrust generated by the thruster system to be directed at a range of angles relative to the keel of the vessel, thereby further assisting in maneuvering of the vessel.

What is claimed is:

1. A tunnel thruster system for a vessel, the tunnel thruster system including a thruster propulsion mechanism including drive unit driving a transmission and propeller assembly in a thruster tunnel, the thruster tunnel comprising:

a propeller section, first and second tapered tunnel sections are interconnected with one another at the propeller section, the propeller section and the first and the second tapered tunnel sections oriented substantially transversely to a keel of the vessel and accommodating the transmission and propeller assembly, each of the first and the second tapered tunnel sections extending from the propeller section to a tunnel opening through a hull of the vessel, and diameters of the first and the second tapered tunnel sections, at the propeller section, corresponding to a diameter of the propeller section and tapering outward toward a larger diameter thereof at each of the corresponding tunnel openings through the hull of the vessel, a diameter of one of the first and the second tapered tunnel sections, at the corresponding hull opening, is greater than a diameter of the other one of the first and the second tunnel sections at the corresponding hull opening, the transmission and propeller assembly supports at least one propeller, the at least one propeller is located in the propeller section, and the transmission and propeller assembly is offset into the tunnel section having the greater diameter so that a different volume or velocity, between the first and the second tapered tunnel sections, is accommodated, and an outward angle of taper of a wall of each of the first and second tapered tunnel sections, relative to a common axis of the first and the second tapered tunnel sections, is in a range of 1 degree to 5 degrees.

2. The tunnel thruster system of claim 1, wherein the transmission and propeller assembly only supports a single propeller.

3. The tunnel thruster system of claim 2, wherein the single propeller is reversible.

4. The tunnel thruster system of claim 2, wherein the single propeller is mounted at an intersection of the propeller section and one of the first and the second tapered tunnel sections.

5. The tunnel thruster system of claim 4, wherein the transmission and propeller assembly includes a gearcase mounted parallel to an axis of a propeller shaft.

6. The tunnel thruster system of claim 4, wherein the transmission and propeller assembly includes a gearcase mounted on a wall of one of the first and the second tapered tunnel sections.

7. The tunnel thruster system of claim 1, wherein the at least one propeller supported by the transmission and propeller assembly comprises one of a pair of opposed propellers and a pair of contra-rotating propellers.

8. The tunnel thruster system of claim 7, wherein the transmission and propeller assembly supports the pair of opposed propellers in which a respective one of the pair of opposed propellers is located on each side of the transmission and propeller assembly.

9. The tunnel thruster system of claim 7, wherein the one of the pair of opposed propellers and the pair of contra-rotating propellers are reversible.

10. The tunnel thruster system of claim 1, wherein the at least one propeller supported by the transmission and propeller assembly comprises a pair of contra-rotating propellers which are both mounted on a same side of the transmission and propeller assembly and rotate in opposite rotational directions from one another.

11. The tunnel thruster system of claim 1, wherein the at least one propeller comprises a first propeller mounted on a first side of the transmission and propeller assembly and a second propeller mounted on a second opposite side of the transmission and propeller assembly.

12. The tunnel thruster system of claim 11, wherein the transmission and propeller assembly includes a gearcase mounted parallel to an axis of a propeller shaft.

13. The tunnel thruster system of claim 11, wherein the transmission and propeller assembly includes a gearcase mounted on a wall of one of the first and the second tapered tunnel sections.

14. The tunnel thruster system of claim 1, wherein the at least one propeller comprises a pair of contra-rotating propellers both mounted on one side of the transmission and propeller assembly.

15. The tunnel thruster system of claim 1, wherein a wall of each of the first and the second tapered tunnel sections has a curved longitudinal profile, with the wall of each tunnel section being convex towards a common axis of the first and the second tapered tunnel sections.

16. The tunnel thruster system of claim 15, wherein the first and the second tapered tunnel sections are non-symmetric.

17. The tunnel thruster system of claim 1, wherein the tapered tunnel sections each comprise a plurality of tunnel subsections and an outermost one of the tunnel subsections, of each of the first and the second tapered tunnel sections, is a parallel walled cylinder.

18. The tunnel thruster system of claim 17, wherein the first and the second tapered tunnel sections are non-symmetric.

19. The tunnel thruster system of claim 1, wherein the transmission and propeller assembly includes a gearcase mounted parallel to an axis of a propeller shaft.

20. A tunnel thruster system for a vessel, the tunnel thruster system including a thruster propulsion mechanism including drive unit driving a transmission and propeller assembly in a thruster tunnel, the thruster tunnel comprising:

a propeller section, first and second tapered tunnel sections interconnected with one another by the propeller section, the propeller section and the first and the second tapered tunnel sections oriented substantially transversely to a keel of the vessel and accommodating the transmission and propeller assembly, each tapered tunnel section extending from the propeller section to a tunnel opening through a hull of the vessel, diameters of the first and the second tapered tunnel sections corresponding to a diameter of the propeller section at the propeller section and tapering outward toward a larger diameter at each of the corresponding tunnel openings through the hull of the vessel, the first and the second tapered tunnel sections each comprise of a plurality of tunnel subsections in which each tunnel subsections comprises a tapered conical walled section and an angle of taper of a wall of each of tunnel subsection is progressively greater from an innermost one of the tunnel subsections to an outermost one of the tunnel subsections, and the first and the second tapered tunnel sections are non-symmetric and a diameter of one of the tapered tunnel sections, at the corresponding hull opening, is greater than the diameter of the other one of the tunnel sections at the corresponding hull opening.

* * * * *